US007500665B2

(12) United States Patent
Lamendola et al.

(10) Patent No.: US 7,500,665 B2
(45) Date of Patent: Mar. 10, 2009

(54) METHOD AND DEVICE FOR IMPROVING PRESSURE CONTROL IN A SHEET FEEDER

(75) Inventors: Nicholas Lamendola, Lima, NY (US); Kenneth P. Moore, Rochester, NY (US); Brian R. Ford, Walworth, NY (US); Maurice Soucy, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 244 days.

(21) Appl. No.: 11/238,493

(22) Filed: Sep. 28, 2005

(65) Prior Publication Data

US 2007/0069446 A1 Mar. 29, 2007

(51) Int. Cl.
*B65H 3/14* (2006.01)

(52) U.S. Cl. ..... 271/97; 271/98

(58) Field of Classification Search ..... 271/97, 271/98

See application file for complete search history.

(56) References Cited

U.S. PATENT DOCUMENTS

| | | | | |
|---|---|---|---|---|
| 4,568,073 | A | 2/1986 | VanHorne | 271/11 |
| 6,186,492 | B1 * | 2/2001 | Dechau et al. | 271/30.1 |
| 6,247,695 | B1 | 6/2001 | Linder et al. | 271/265.04 |
| 6,264,188 | B1 | 7/2001 | Taylor et al. | 271/98 |
| 6,290,225 | B1 * | 9/2001 | Linder et al. | 271/155 |
| 6,332,607 | B1 | 12/2001 | Van Der Werff | 271/101 |
| 6,398,208 | B1 | 6/2002 | Yang et al. | 271/107 |
| 6,450,493 | B1 | 9/2002 | Milillo et al. | 271/11 |
| 6,669,187 | B1 | 12/2003 | Clark | 271/98 |
| 6,729,614 | B2 | 5/2004 | Okazaki et al. | 271/97 |
| 6,746,011 | B2 | 6/2004 | Miller et al. | 271/97 |
| 6,768,884 | B1 | 7/2004 | Buchheit | 399/88 |
| 6,772,628 | B2 | 8/2004 | Clark | 73/159 |
| 6,863,272 | B2 * | 3/2005 | DiNatale et al. | 271/97 |
| 2004/0100013 | A1 | 5/2004 | Mathewson | 271/98 |
| 2004/0245711 | A1 | 12/2004 | Domoto et al. | 271/197 |
| 2005/0156370 | A1 * | 7/2005 | Lang et al. | 271/9.1 |

* cited by examiner

*Primary Examiner*—Kaitlin S Joerger
(74) *Attorney, Agent, or Firm*—Alix, Yale & Ristas, LLP

(57) ABSTRACT

Disclosed herein is a sheet feeding apparatus including a blower for blowing air through a stack of sheets, and a controller configured to operate the blower at a high power setting for a predetermined time period based upon elapsed off time and to subsequently operate the blower at a target power setting. A printer, a method of controlling blower power, and a method of minimizing misfeeds are also disclosed.

20 Claims, 4 Drawing Sheets

METHOD AND DEVICE FOR IMPROVING PRESSURE CONTROL IN A SHEET FEEDER

BACKGROUND

The presently disclosed embodiments relate to pneumatic sheet feeders.

In the process of electrophotographic reproduction, a light image of an original to be copied or printed is typically recorded in the form of a latent electrostatic image upon a photosensitive member, with a subsequent rendering of the latent image visible by the application of electroscopic marking particles, commonly referred to as toner. The visual toner image can be either fixed directly upon the photosensitive member or transferred from the member to another support medium or substrate, such as a sheet of plain paper. To render this toner image permanent, the image must be "fixed" or "fused" to the paper, generally by the application of heat and pressure.

With the advent of high speed xerography reproduction machines wherein copiers or printers can produce at a rate in excess of three thousand copies per hour, the sheet handling system must feed paper or other media through each process station in rapid succession in a reliable and dependable manner in order to utilize the full capabilities of the reproduction machine. The sheet handling systems must operate flawlessly to virtually eliminate the risk of damaging the recording sheets and generate minimum machine shutdowns due to misfeeds or multifeeds.

A high speed xerography reproduction machine typically includes a feeder assembly for feeding sheets to the image transfer portion of the machine. The feeder assembly may employ, for example, friction retard or vacuum belt corrugation feeder technology with air assist, or shuttle feeder technology. The feeder typically has a fixed set of operating parameters. These settings may be the best compromise for feeding most types of sheets, and, as a result, the sheet feeding capability is generally limited to the range that these parameters allow. While this approach may satisfy the needs of general use copying and printing, it limits the range of sheets that can be fed in the production environment where expanded range is needed. In response to this problem, feeder control systems have been developed which provide the users of high speed xerographic machines with the ability to adjust some of the feeder operating parameters to expand the range of sheets (from very light to extra heavy weight) that can be used with the machines.

Pneumatic sheet feeders use both vacuum pressure and positive pressure to separate and acquire a single sheet from a stack. The positive pressure is used to fluff the sheets to separate the top sheets in the stack. If the fluffer pressure is too high, multiple sheets can be sent at one time, causing a paper jam or the inclusion of blank sheets in a stack of printed material.

The optimal fluffer pressure changes as sheets of different weight are fed. A single sheet feeding apparatus typically is designed to accommodate sheets of varying weights. To avoid multifeeding of sheets, the fluffer must therefore have a blower speed that can be adjusted depending upon the weight of the sheets being fed.

The time required to adjust the fluffer or other device to the appropriate pressure when sheet weight is changed results in a delay in feeding. It would be useful to develop a system that has minimal time delays for adjusting pressure while ensuring that sheet feeding errors are prevented.

SUMMARY

One embodiment disclosed herein is a sheet feeding apparatus comprising a blower for blowing air through a stack of sheets or acquiring a single sheet, and a controller configured to operate the blower at a high power setting for a predetermined time period based upon elapsed off time and to subsequently operate the blower at a target power setting. In some cases, the controller measures the elapsed off time of the blower.

Frequently, the controller receives input indicative of at least one sheet property, such as sheet weight. The blower often blows air through a stack of sheets in order to fluff the sheets. The predetermined time period for running the blower at the high power setting typically is also based upon the target power setting. The target power setting imparts a pressure that does not exceed a target pressure.

Another embodiment is a printer having a sheet feeding apparatus that includes a blower for blowing air through a stack of sheets or acquiring a single sheet, and a controller configured to operate the blower at a high power setting for a predetermined time period based upon elapsed off time and to subsequently operate the blower at a target power setting. In many cases, the controller receives input indicative of sheet weight.

A further embodiment is a method for controlling blower power for a sheet feeding apparatus, comprising determining an off time for a blower, determining a target power setting for the blower, determining a high power time period for the blower based upon the off time, and operating the blower at a high power setting for the high power time period and subsequently operating the blower at the target power setting.

In most cases, the target power setting is based upon a characteristic of the sheets. The high power time period is often further based upon the target power setting. The method often further comprises inputting sheet weight data into a controller that calculates the target power setting. In many cases, the method further comprises switching the blower from the target power setting to an off setting. Often, the controller measures the off time for the blower.

Yet another embodiment is a method of minimizing misfeeds in a sheet feeding apparatus, comprising providing a blower with a controller that determines the off time for the blower and determines a time period for which the motor is to be run at a high power setting before being reduced to a target power setting. The target power setting frequently depends upon sheet weight. The controller usually cycles down the blower after completing the feeding of sheets.

DETAILED DESCRIPTION

Figure 1:
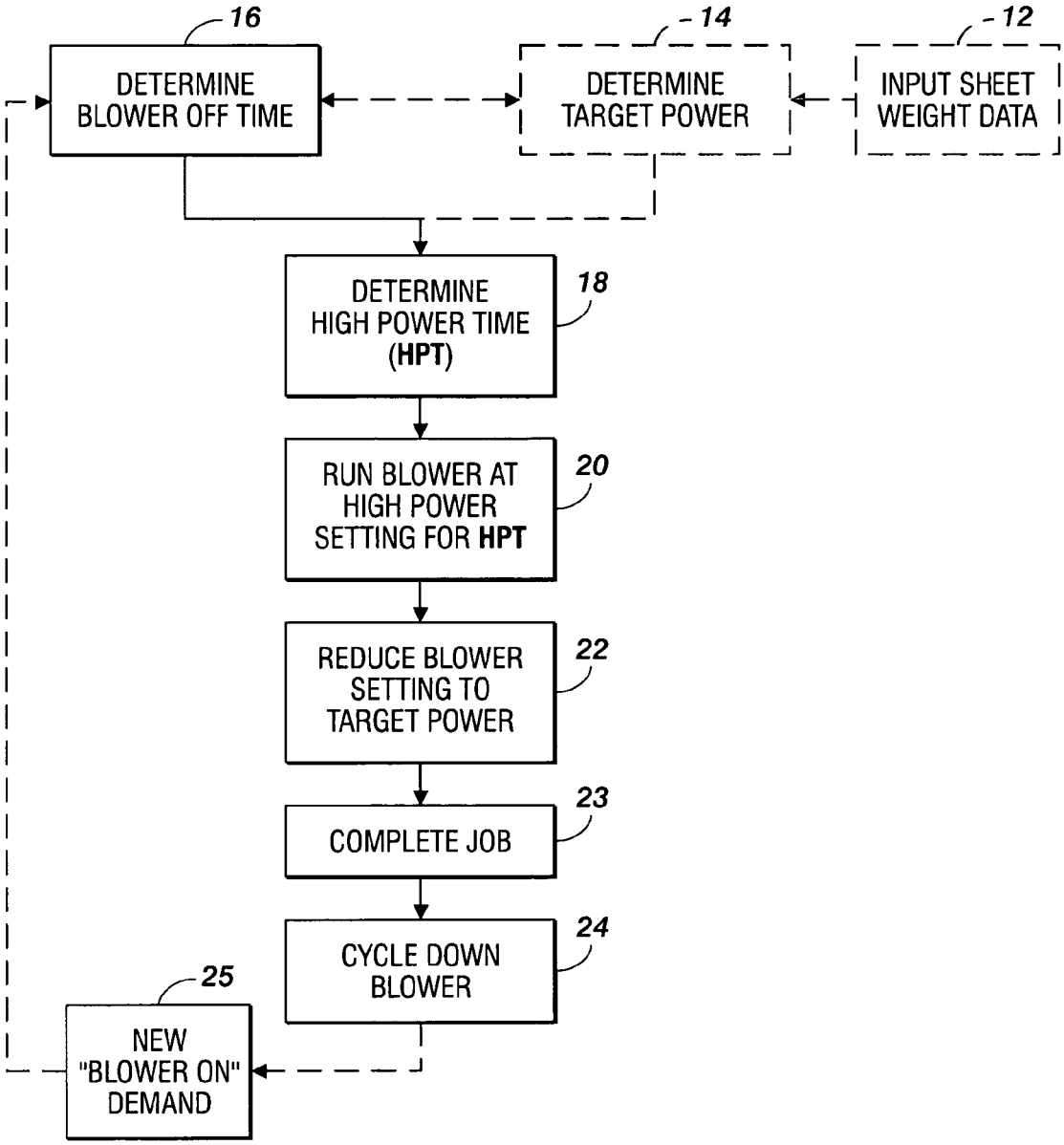
FIG. 1 is a flow sheet for a method of controlling blower power in order to reduce the pressure adjustment time when changing sheet types in a sheet feeding apparatus.

The embodiments described herein increase the number of sheets that can be fed per hour by a pneumatic feeding device utilizing one or more fluffers or other devices while preventing multifeeds. These embodiments are particularly well suited for use in connection with printers. The term "printer" encompasses any apparatus, such as a digital copier, bookmaking machine, facsimile machine, multi-function machine, etc. which incorporates a print outputting function for any purpose. The term "sheet" encompasses any stackable substrate which can be separated by air flow in order to facilitate the feeding of individual pieces through a printer. Typically, but not necessarily, a sheet comprises a thin layer of paper, cardboard, or plastic. The term "sheet feeding apparatus" includes any apparatus, such as a pneumatic feeder, which is capable of individually delivering a plurality of media sheets in rapid succession. A printer usually includes at least one sheet feeding apparatus. A "blower" is either a positive pressure blower, such as is used for a fluffer or air knife, or a negative pressure (vacuum) blower.

As used herein, a "fluffer" is a type of pneumatic sheet feeding apparatus that is used in conjunction with a printer or other apparatus that receives individual sheets for processing. A fluffer includes a blower with an integrated motor or a blower connected to a motor that is turned on and off by a controller. The "off time" for the motor is the period of elapsed time from when the power switch to the motor is moved to an "off" or "cycle down" position until the power switch is moved back to an "on" or "cycle up" position. After the motor power is switched off, the speed of the motor slows down until it stops or until it is switched back on.

Different power settings are used for the blower depending upon the intended pressure. The desired amount of pressure depends on the weight of the paper being fed. Heavier weight paper requires more pressure than lightweight paper. Excessive fluffer pressure for a given weight of paper can compress a stack of sheets against the feed head, causing a multifeed. A variable speed blower is selected such that the blower has a maximum pressure delivery capacity that is appropriate for feeding the heaviest weight paper to be run on a particular machine. However, a blower that is designed to accommodate the heaviest sheets does not have enough torque to start if it is set to the power level that corresponds to the target pressure for the lightweight sheets. For sheets other than those of the heaviest weight, the blower is therefore started and run briefly at high power and then adjusted downwardly to a power setting that corresponds to a target pressure. The "target pressure" is the intended operating pressure for the blower after it reaches a steady operating state. The motor power level that corresponds to this pressure setting is referred to herein as the "target power setting" for the motor. The "high power setting" is a relatively high power level that is usually predetermined and is higher than the target power setting. In many cases, the "high power setting" is a full power setting or the maximum power setting that is typically used for a particular motor.

If the blower has been cycled down but has not stopped spinning, it will often overshoot its target RPM when cycled back up if it is run at high power for the same time period as would be used if it had actually stopped spinning. Overshooting of the target RPM is likely to happen, for example, when the feeder is cycled up soon after it has been cycled down. In order to prevent multifeeds resulting from excessive blower pressure, a system has been created to keep track of how long a blower has been cycled down and to determine a reduced amount of time that the blower is to be run at a high power setting before being adjusted to its target power setting. This method enables the blower to automatically achieve its desired speed quickly and efficiently, thereby minimizing feeding delays and improving sheet feed rates while preventing multifeeds. The measured "off time" is used to determine the amount of time the blower is to run at high power before it is adjusted to the power which corresponds to the target pressure. The system allows the blower to automatically reach the desired final speed or power level in the least amount of time.

Referring to the drawings and first to FIG. 1, a flow sheet is shown for a method of controlling blower pressure in order to minimize multifeeds and reduce start-up time. First, the weights of the media sheets to be run on a particular machine are input at 12 and the sheets are grouped based on weight. In many cases the sheet weight is part of a database of sheet characteristics. In one embodiment the media sheets are divided into four weight groups. In one embodiment, the lightest group, designated as "normal," has sheet weights in the range of 49-84 grams per square meter (gsm). The second group, designated as "medium,' has weights in the range of 85-105 gsm. The third group, designated as "heavy," has weights in the range of 106-216 gsm. The fourth group, designated as "extra heavy," has weights in the range of 217-280 gsm. These weight ranges may vary or be greater or fewer in number. The target power for each weight group usually has been determined in advance.

Next, the target power for the blower corresponding to a particular set of sheets to be fed is determined at 14. This typically is based upon the weight group for the media. The amount of time that the blower has been cycled down (usually, turned off) is determined at 16. These two determinations can take place simultaneously or sequentially in either order. The high power time is then determined at 18 based upon the fan speed at the restart time, the start-up rate for the particular fan, and the desired final blower speed. The blower is then cycled up at 20 and run at a high power setting for the high power time (HPT). Feeding is not commenced until the desired blower pressure is achieved, so the HPT is minimized in order to provide maximum sheet feeding efficiency. The blower power is then reduced to the target power setting at 22. In one embodiment, the highest weight bucket requires the maximum blower pressure to be used, so no downward adjustment in blower pressure is needed after start-up. When the required job is completed at 23, the blower power is cycled down (usually, turned off) at 24. The blower remains at the "off" setting until a new "blower on" demand is made at 25. When the next set of sheets to be fed is of the same weight as the previous set, the process is repeated by determining the blower off time at 16 and determining the high power time at 18. When the next set of sheets to be fed has a different weight than the previous set, the blower off time is determined at 16 and a new target power setting is determined at 14.

Figure 2:
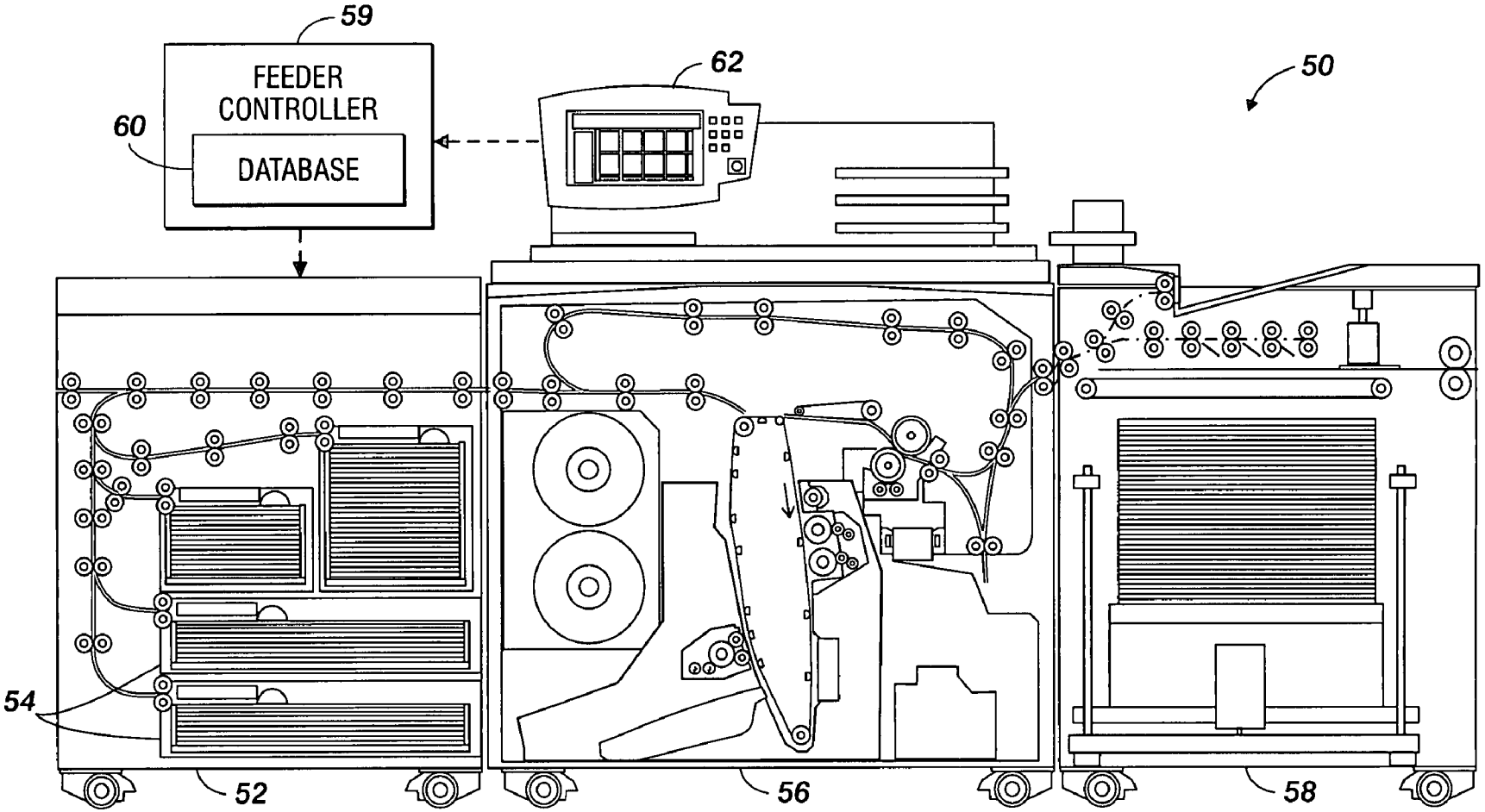
FIG. 2 is a schematic diagram showing a printer that includes a fluffer.

Referring next to FIG. 2, a printing apparatus 50 is shown that includes a sheet feeder module 52 having one or more feeder assemblies 54 that store and dispense sheets upon which images are to be printed, a printing engine 56 that includes hardware by which image signals are used to create a desired image, and a finisher 58. A feed controller 59 controls the components of the sheet feeder module 52. The feed controller 59 typically but not necessarily contains feeder capabilities and constraints database 60. If the printing apparatus 50 is operable as a copier, it further includes a document feeder (not shown), which also may include a sheet feeding apparatus of the type described herein. The printing apparatus often also includes a local user interface 62 for inputting data, although another source of image data and instructions may include any number of computers to which the printer is connected via a network. Further details regarding the overall structure and function of the printing apparatus are described in U.S. Published Patent Application No. 2005/0156370, the contents of which are incorporated herein by reference in their entirety. It is noted that the feeder assemblies 54 may be contained within virgin media or pre-printed media feeding modules or as part of a document handler feeding device used for scanning images.

The sheet feeder module 52 usually has many control parameters that are "fixed" during the design stage along with some that are variable and controlled through the machine software. The variable control parameters include the blower power, which controls the fluffer air pressure, the vacuum level, whether the air supply heater is on or off, the stack height, and timing.

Figure 3:
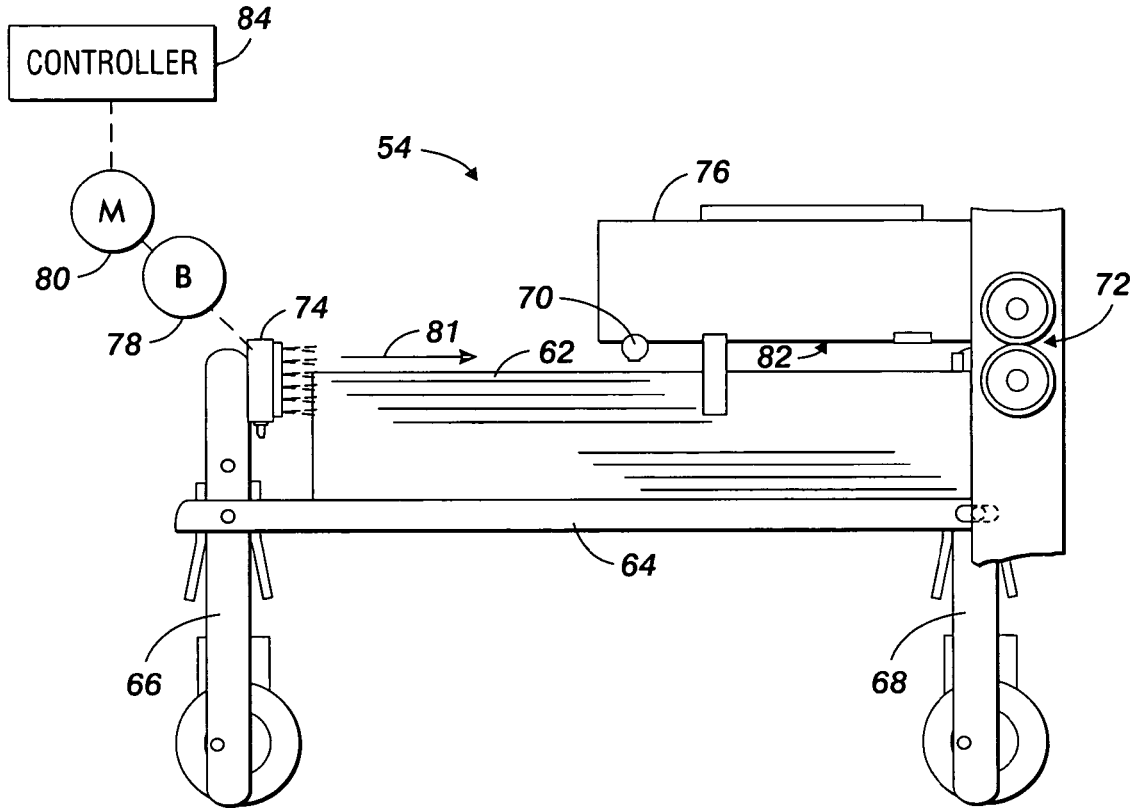
FIG. 3 is a schematic diagram showing details of the fluffer of FIG. 2.

Referring to FIG. 3, a schematic side elevational view of a feeder assembly 54 is shown. The feeder assembly 54 includes a stack 62 of sheets in a sheet support tray 64, multiple tray elevators 66, 68, a stack height sensor 70, a take away roll 72, at least one fluffer component 74, and a vacuum feed head 76. Fluffer components 74 may be on one, two or three sides of the stack 62. The feed head 76 includes an acquisition surface 82. The fluffer component 74 is connected to a blower 78 that blows air in the general direction of arrow 81 between sheets in the stack and on the top surface of the sheet to be fed. The air pressure between sheets helps separate sheets and puff the sheets up. This is done to separate some of the top sheets from the lower part of the stack 62 and to make the top sheets more easily acquired by the vacuum feed head 76. This improves the sheet acquisition speed and ensures a single sheet feed.

The air pressure of the fluffer component 74 can be set to a particular level. The speed or power of the blower motor 80 for the stack 62 on tray 64 is set by a controller 84 using, for example, the brushless DC blower motor input voltage level. It is noted that the blower 78 and motor 80 may be separate or may be combined into one assembly. When the feeder is operated in "auto" mode, the target power level of the blower is set to result in a fluffer air pressure appropriate for the weight of the sheets to be fed. It is noted that in some cases the apparatus permits sheets to be fed via manual mode, in which case parameters such a fluffer air pressure, vacuum level, air supply heating, etc. can be separately adjusted by an operator. The "auto" mode of operation is usually the default mode.

The sheet feeder module 52 preferably but not necessarily employs shuttle feeder technology, which at a simplified level uses vacuum corrugated belt feeders that physically translate the sheet from the stack to the takeaway rolls. Vacuum belt corrugation feeders or friction retard feeders with air assist can also employ this blower control concept.

The following Example is included to illustrate features of the invention but is not intended to be construed as limiting.

EXAMPLE

A SFM2 feeder of a Nuvera® printer/copier (2004 version, Xerox® Corp.) was loaded with media sheets of various weights in different media trays, and a high blower power cycle-up time was determined for various "off times" and target pressures in order to start the fluffer while preventing the pressure from exceeding the target pressure. The results are shown below on Table 1.

TABLE 1

| Normal Delay Time From Blower Off Range (sec.) | Normal 100% PWM On Time (ms) | Normal Delay Time from Blower Off Range (sec.) | Medium 100% PWM On Time (ms) | Heavy Delay Time from Blower Off Range (sec.) | Heavy 100% PWM On Time (ms) |
|---|---|---|---|---|---|
| 0.000-0.560 | 160 | 0.000-0.350 | 140 | 0.000-0.220 | 120 |
| 0.560-1.360 | 340 | 0.350-0.780 | 290 | 0.220-0.450 | 225 |
| 1.360-2.530 | 560 | 0.780-1.340 | 450 | 0.450-0.670 | 330 |
| 2.530-4.690 | 910 | 1.340-2.140 | 660 | 0.670-0.970 | 470 |
| 4.690-6.700 | 1090 | 2.140-3.310 | 890 | 0.970-1.320 | 620 |
| 6.700-8.720 | 1250 | 3.310-5.470 | 1070 | 1.320-1.750 | 750 |
| 8.720-10.740 | 1370 | 5.470-7.480 | 1360 | 1.750-2.310 | 910 |
| 10.740-12.750 | 1490 | 7.480-9.500 | 1580 | 2.310-3.110 | 1100 |
| 12.750-15.810 | 1660 | 9.500-11.520 | 1700 | 3.110-4.280 | 1340 |
| >15.810 | 1740 | 11.520-13.530 | 1780 | 4.280-6.440 | 1470 |
| | | 13.530-16.590 | 1950 | 6.440-8.450 | 1820 |
| | | >16.590 | 2040 | 8.450-10.460 | 2000 |
| | | | | 10.460-12.470 | 2120 |
| | | | | 12.470-14.500 | 2240 |
| | | | | 14.500-17.560 | 2390 |
| | | | | >17.560 | 2420 |

Figure 4:
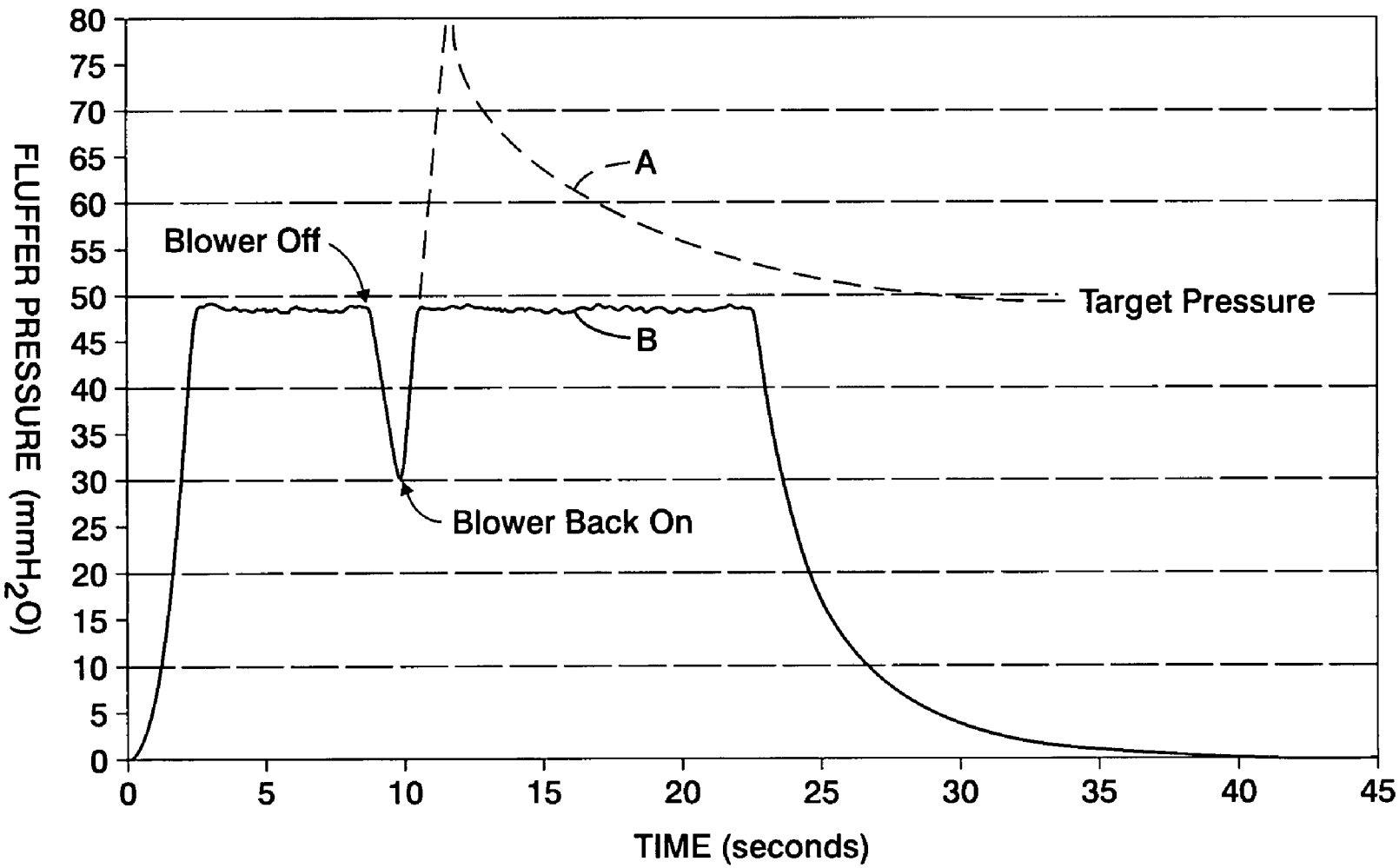
FIG. 4 is graph showing the fluffer pressure at the time of start-up with and without use of the method shown in FIG. 1.

As is shown in FIG. 4, the Nuvera® printer/copier was operated using heavy weight paper with and without the correction for blower off time. In the first case "A", when no correction was used, the blower was started at high (in this case, full) power after having cycled down for 2 seconds and was then run for 5 seconds before being reduced to a target power. Because the blower speed was not yet zero when the blower motor was restarted, the blower pressure exceeded the target pressure during start-up. In the second case "B", the off time was measured and used to determine how long the blower should be run at high power before being reduced to a target power. In this case, the target pressure level was not exceeded during start-up after being cycled down for 2 seconds.

As is shown in FIG. 4, the use of the high power times from Table 1 resulted in the target blower pressure being reached within 11 seconds without any over-pressurization above the target pressure of 50 $mmH_20$. On the other hand, when the correction technique was not used, the pressure exceeded 80 $mmH_20$. An algorithm can be calculated (for a particular blower or a particular model of blower) based upon a table or equation for use with different systems and substrates. This type of algorithm generally provides that the high power time is a function of off time and target pressure. Different blowers may have different cycle up and cycle down times.

It will be appreciated that various of the above-disclosed and other features and functions, or alternatives thereof, may be desirably combined into many other different systems or applications. These can include applying the same control strategy to the vacuum side of a sheet feeding apparatus. In such a case, the vacuum may be applied at two or more levels in order to prevent bleeding high vacuum through thin sheets causing multifeeds. It is advantageous to use similar blower controls to those described previously to prevent the creation of too high a vacuum pressure when a blower starts up after recently cycling down. Various presently unforeseen or unanticipated alternatives, modifications, variations, or improvements therein may be subsequently made by those skilled in the art which are also intended to be encompassed by the following claims, which can encompass embodiments in hardware, software, or a combination thereof.

What is claimed is:

1. A sheet feeding apparatus comprising:

a blower for blowing air through a stack of sheets or acquiring a single sheet, and a controller configured to measure elapsed off time of the blower, operate the blower at a high power setting for a predetermined time period based upon elapsed off time, and subsequently operate the blower at a target power setting that is lower than the high power setting.

2. The sheet feeding apparatus of claim 1, wherein the controller receives input indicative of at least one sheet property.

3. The sheet feeding apparatus of claim 1, wherein the blower blows air through a stack of sheets in order to fluff the sheets.

4. The sheet feeding apparatus of claim 1, wherein the predetermined time period is further based upon the target power setting.

5. The sheet feeding apparatus of claim 4, wherein the target power setting varies with sheet weight.

6. The sheet feeding apparatus of claim 1, wherein the target power setting imparts a pressure that does not exceed a target pressure.

7. A printer, comprising:

a sheet feeding apparatus including a blower for blowing air through a stack of sheets or acquiring a single sheet, and a controller configured to measure the elapsed off time of the blower, operate the blower at a high power setting for a predetermined time period based upon elapsed off time, and subsequently operate the blower at a target power setting that is lower than the high power setting.

8. The printer of claim 7, wherein the controller receives input indicative of sheet weight.

9. A method for controlling blower power for a sheet feeding apparatus, comprising:

determining an off time for a blower, determining a target power setting for the blower, determining a high power time period for the blower based upon the off time and the target power setting, and operating the blower at a high power setting for the high power time period and subsequently operating the blower at the target power setting that is lower than the high power setting, wherein a controller measures elapsed off time for the blower.

10. The method of claim 9, wherein the target power setting is based upon at least one sheet property.

11. The method of claim 9, wherein high power time period is further based upon the target power setting.

12. The method of claim 9, wherein sheet weight data is input into the controller, which calculates the target power setting.

13. The method of claim 9, further comprising switching the blower from the target power setting to an off setting.

14. A method of minimizing misfeeds in a sheet feeding apparatus, comprising providing a blower connected to a controller that determines the elapsed off time for the blower and determines a time period for which a motor is to be run at a high power setting before being reduced to a target power setting.

15. The method of claim 14, wherein the target power setting depends upon sheet weight.

16. The method of claim 14, wherein the controller cycles down the blower after completing the feeding of sheets.

17. The sheet feeding apparatus of claim 2, wherein the predetermined time period is further based upon the target power setting and the target power setting varies with sheet weight.

18. The sheet feeding apparatus of claim 17, wherein the target power setting imparts a pressure that does not exceed a target pressure.

19. The sheet feeding apparatus of claim 1, wherein the controller is configured to determine the predetermined time period.

20. The sheet feeding apparatus of claim 19, wherein the predetermined time period does not exceed 11 seconds and the blower operates at a pressure of no more than 50 $mmH_2O$.

* * * * *